US009869134B2

(12) United States Patent
Nakamura et al.

(10) Patent No.: US 9,869,134 B2
(45) Date of Patent: Jan. 16, 2018

(54) DRILLING TOOL

(71) Applicant: MITSUBISHI MATERIALS CORPORATION, Tokyo (JP)

(72) Inventors: Kazuyoshi Nakamura, Anpachi-gun (JP); Hiroshi Ota, Anpachi-gun (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 317 days.

(21) Appl. No.: 14/771,594

(22) PCT Filed: Mar. 6, 2014

(86) PCT No.: PCT/JP2014/055854

§ 371 (c)(1),
(2) Date: Aug. 31, 2015

(87) PCT Pub. No.: WO2014/142011

PCT Pub. Date: Sep. 18, 2014

(65) Prior Publication Data

US 2016/0002983 A1 Jan. 7, 2016

(30) Foreign Application Priority Data

Mar. 14, 2013 (JP) ..... 2013-052244

(51) Int. Cl.
*E21B 10/60* (2006.01)
*E21B 7/20* (2006.01)
(Continued)

(52) U.S. Cl.
CPC ..... *E21B 10/602* (2013.01); *E21B 7/20* (2013.01); *E21B 10/18* (2013.01); *E21B 10/43* (2013.01); *E21B 10/56* (2013.01); *E21B 10/64* (2013.01)

(58) Field of Classification Search
CPC ..... E21B 7/20; E21B 10/60; E21B 10/64
See application file for complete search history.

(56) References Cited

U.S. PATENT DOCUMENTS

2015/0300094 A1* 10/2015 Hisada ..... E21B 7/20 175/402
2015/0330151 A1* 11/2015 Egerstrom ..... E21B 7/208 175/305

(Continued)

FOREIGN PATENT DOCUMENTS

CN 201802311 U 4/2011
CN 102076925 A 5/2011

(Continued)

OTHER PUBLICATIONS

Office Action dated May 23, 2016, issued for the Chinese patent application No. 201480007195.0 and English translation of a part of Search Report.

(Continued)

*Primary Examiner* — Shane Bomar
(74) *Attorney, Agent, or Firm* — Locke Lord LLP

(57) ABSTRACT

The inner bit is provided with: a supply hole which is open at the distal end portion of the inner bit; and a discharge groove which is formed in an outer peripheral surface of the inner bit and extends in the direction of the axial line. The supply hole is provided with: a distal end blow hole which is open in a distal end surface of the distal end portion of the inner bit; and an outer peripheral blow hole which is open in an outer peripheral surface of the distal end portion of the inner bit. An outer peripheral groove via which the outer peripheral blow hole communicates with the discharge groove is formed in the outer peripheral surface of the inner bit. The outer peripheral groove is covered with the ring bit from the outside in a radial direction.

20 Claims, 7 Drawing Sheets

(51) Int. Cl.

| | |
|---|---|
| ***E21B 10/18*** | (2006.01) |
| ***E21B 10/56*** | (2006.01) |
| ***E21B 10/64*** | (2006.01) |
| ***E21B 10/43*** | (2006.01) |

(56) References Cited

U.S. PATENT DOCUMENTS

| | | | | |
|---|---|---|---|---|
| 2017/0081923 | A1* | 3/2017 | Nakamura | E21B 7/208 |
| 2017/0234075 | A1* | 8/2017 | Nakamura | E21B 10/32 |

FOREIGN PATENT DOCUMENTS

| | | | |
|---|---|---|---|
| JP | 11-159271 | A | 6/1999 |
| JP | 2001-140578 | A | 5/2001 |
| JP | 3968309 | B2 | 8/2007 |
| JP | 2010-216101 | A | 9/2010 |
| JP | 2012-127062 | A | 7/2012 |
| JP | 2012-515866 | A | 7/2012 |
| WO | WO-2010/084238 | A1 | 7/2010 |

OTHER PUBLICATIONS

International Search Report dated May 27, 2014, issued for PCT/JP2014/055854.
Supplementary European Search Report dated Oct. 7, 2016, issued for the European patent application No. 14765690.4.

* cited by examiner

DRILLING TOOL

TECHNICAL FIELD

The present invention relates to a drilling tool, in which a distal end portion of an inner bit inserted into a casing pipe protrudes from a distal end of the casing pipe, the inner bit engages with a ring bit rotatably disposed at the distal end of the casing pipe so as to be rotatable integrally with the ring bit, and the inner bit and the ring bit excavate the ground to form a borehole while the casing pipe is inserted into the borehole.

Priority is claimed on Japanese Patent Application No. 2013-052244, filed Mar. 14, 2013, the content of which is incorporated herein by reference.

BACKGROUND ART

In the related art, as this type of drilling tool, a drilling tool is known which includes: a casing pipe having a cylindrical shape; an inner bit which is inserted into the casing pipe in the direction of the axial line thereof and of which a distal end portion in the direction of the axial line protrudes from a distal end of the casing pipe; and a ring bit which has an annular shape, is disposed at a distal end portion of the casing pipe so as to be capable of rotating around the axial line relative to the casing pipe, surrounds the distal end portion of the inner bit, and is capable of engaging with the inner bit around the axial line and from the distal end side in the direction of the axial line (refer to, for example, PTLs 1 and 2 described below).

FIGS. 6 and 7 show a conventional drilling tool 100. In the drilling tool 100, a distal end portion of an inner bit 102 inserted into a casing pipe 101 protrudes from a distal end of the casing pipe 101. The inner bit 102 engages with a ring bit 103 rotatably disposed at the distal end of the casing pipe 101 so as to be rotatable integrally with the ring bit 103. Further, the ring bit 103 can engage with the inner bit 102 from the distal end side in the direction of the axial line O thereof.

Then, an impelling force and striking force toward the distal end side in the direction of the axial line O (the lower side in FIG. 6) and a rotating force around the axial line O are applied to the inner bit 102. Thereby, the inner bit 102 and the ring bit 103 engaging therewith excavate the ground to form a borehole while the casing pipe 101 is inserted (drawn) into the borehole.

Further, the inner bit 102 includes: a supply hole 104 which passes through the inner bit 102 and is open at the distal end portion of the inner bit 102; and a discharge groove 105 which is formed in the outer peripheral surface of the inner bit 102 and extends in the direction of the axial line O. Further, the supply hole 104 includes: a distal end blow hole 106 which is open in the distal end surface of the inner bit 102; and an outer peripheral blow hole 107 which is open in the outer peripheral surface of the inner bit 102. The distal end blow hole 106 is open into a distal end groove 108 which is formed in the distal end surface of the inner bit 102 and communicates with the discharge groove 105, and the outer peripheral blow hole 107 is open toward the distal end surface of the ring bit 103.

Then, during excavation, a fluid (an ejection medium) such as air is ejected onto the distal end surface of the inner bit 102 and the distal end surface of the ring bit 103 through the supply hole 104, while the fluid and a drill waste (a slime) generated by the excavation are discharged toward the tool base end side through the discharge groove 105.

CITATION LIST

Patent Literature

[PTL 1] Japanese Patent No. 3968309

[PTL 2] Published Japanese Translation No. 2012-515866 of the PCT International Publication

SUMMARY OF INVENTION

Technical Problem

However, in the conventional drilling tool 100 described above, there is the following problem.

That is, the drill waste which is generated by excavating the ground using the drilling tool 100 is discharged by a fluid which is supplied from a drilling apparatus (not shown). However, in the soft ground, the fluid infiltrates into the ground around the borehole, and thus the drill waste cannot be discharged. As a result, for example, the drill waste is accumulated in the borehole, whereby there is a case where digging cannot be stably performed. Further, in some cases, the fluid having infiltrated into the ground around the borehole makes the ground loose, whereby there is a case where the foundation of a structure in the vicinity is affected.

The present invention has been made in view of such circumstances and has an object to provide a drilling tool, in which a fluid ejected from a supply hole of an inner bit and a drill waste generated by excavation can be efficiently recovered into a discharge groove of the inner bit and can be stably discharged toward the base end side of the tool through the discharge groove, and thereby, it is possible to highly efficiently and stably proceed with drilling tasks and to limit the influence on the ground around a borehole.

Solution to Problem

In order to solve such problem and achieve the above object, the present invention proposes the following means.

According to an aspect of the present invention, a drilling tool used for excavating a ground to form a borehole, the tool including: a casing pipe having a cylindrical shape; an inner bit which is inserted into the casing pipe in a direction of an axial line thereof and of which a distal end portion in the direction of the axial line protrudes from a distal end of the casing pipe; and a ring bit which has an annular shape, is disposed at a distal end portion of the casing pipe so as to be rotatable around the axial line relative to the casing pipe, surrounds the distal end portion of the inner bit, and is capable of engaging with the inner bit around the axial line and from a distal end side of the inner bit in the direction of the axial line, in which the inner bit is provided with: a supply hole which passes through the inner bit and is open at the distal end portion of the inner bit; and a discharge groove which is formed in an outer peripheral surface of the inner bit and extends in the direction of the axial line, the supply hole is provided with: a distal end blow hole which is open in a distal end surface of the distal end portion of the inner bit; and an outer peripheral blow hole which is open in an outer peripheral surface of the distal end portion of the inner bit, an outer peripheral groove through which the outer peripheral blow hole and the discharge groove communicate with each other is formed in the outer peripheral surface of the inner bit, and the outer peripheral groove is covered with the ring bit from the outside in a radial direction and extends toward the discharge groove from the outer peripheral blow hole so as to become gradually closer to the base end side in the direction of the axial line around the axial line.

In the drilling tool, an impelling force and striking force toward the distal end side of the tool in the direction of the axial line and a rotating force around the axial line are applied to the inner bit. Thereby, the inner bit and the ring bit engaging therewith excavate the ground to form a borehole. At the same time, the casing pipe is inserted (drawn) into the borehole. Further, along with the excavation, a fluid (an ejection medium) such as air is ejected onto the distal end surface of the inner bit through the supply hole, while the fluid and a drill waste (a slime) generated by the excavation are discharged toward the base end side of the tool through the discharge groove.

According to the aspect of the drilling tool in the present invention, the outer peripheral blow hole of the supply hole communicates with the discharge groove through the outer peripheral groove formed in the outer peripheral surface of the inner bit, and the outer peripheral groove is covered with the ring bit from the outside in the radial direction and extends toward the discharge groove from the outer peripheral blow hole so as to become gradually closer to the base end side in the direction of the axial line around the axial line. Therefore, the following operation and effects are exhibited.

That is, the fluid in the outer peripheral groove flows into the discharge groove, while forming a flow toward the base end side in the direction of the axial line from the outer peripheral blow hole to the discharge groove. Therefore, it becomes easier for the fluid and the drill waste in the discharge groove to flow toward the base end side of the tool.

Further, since the outer peripheral groove is covered with the ring bit from the outside thereof in the radial direction, the fluid ejected from the outer peripheral blow hole into the outer peripheral groove is efficiently sent toward the discharge groove while being prevented from infiltrating into the ground. Therefore, the recovery efficiency of the fluid and the drill waste flowing through the discharge groove is improved.

In addition, since in this manner, the outer peripheral groove is covered with the ring bit, infiltration of the drill waste into the outer peripheral groove is limited, and thus the outer peripheral groove is prevented from being clogged with the drill waste. In addition to this, a flow path in the outer peripheral groove is stably secured, and thus the flow velocity of the fluid flowing through the outer peripheral groove is stably maintained. Thereby, also in the discharge groove into which the fluid flows from the outer peripheral groove, the flow velocity of the fluid and the drill waste flowing through the inside of the discharge groove is quickened. As a result, due to the Venturi effect, the pressure in the discharge groove becomes lower than the pressure around the distal end surface of the inner bit, whereby the fluid and the drill waste around the distal end surface are easily drawn into the discharge groove having a lower pressure and is easily sent to the base end side of the tool through the discharge groove.

In this manner, according to the aspect of the present invention, the fluid ejected from the supply hole of the inner bit and the drill waste generated by excavation can be efficiently recovered into the discharge groove of the inner bit and can be stably discharged toward the base end side of the tool through the discharge groove. Thereby, it is possible to highly efficiently and stably proceed with drilling tasks and to limit the influence on the ground around the borehole.

In the drilling tool according to above aspect of the present invention, the distal end blow hole may be formed in the distal end surface of the inner bit and may be open into a distal end groove which communicates with the discharge groove; and the outer peripheral blow hole may be open into the outer peripheral groove.

In this case, the fluid ejected from the distal end blow hole is efficiently guided into the discharge groove through the distal end groove together with the drill waste around the distal end surface of the inner bit. Thereby, efficiency in recovering the fluid and the drill waste is increased. Further, since the outer peripheral blow hole is directly open into the outer peripheral groove, the above-described operation and effects become more remarkable.

In the drilling tool according to above aspect of the present invention, it is preferable that a plurality of the distal end blow holes be open in the distal end surface of the inner bit, and at least one of the distal end blow holes extend so as to be parallel to the axial line or extend so as to gradually approach the axial line toward the distal end side of the tool.

In this case, the fluid ejected from the distal end blow hole can be prevented from escaping toward the outer periphery side from the distal end surface of the inner bit. Thereby, the ground around the borehole can be efficiently prevented from becoming loose. Further, the fluid ejected from the distal end blow hole easily spreads over the entirety of the distal end surface of the inner bit, and thus excavation efficiency is further increased.

Further, it becomes easy to secure a large distance along the radial direction from a portion in which the distal end blow hole is open in the distal end surface of the inner bit (for example, into the distal end groove) to the discharge groove of the outer peripheral surface of the inner bit. Therefore, efficiency in recovering the drill waste is improved.

In the drilling tool according to above aspect of the present invention, in the direction of the axial line, the distal end surface of the ring bit may be disposed at the same position as the distal end surface of the inner bit or disposed so as to protrude toward the distal end side of the tool relative to the distal end surface of the inner bit.

In this case, since the inner bit does not protrude toward the distal end side of the tool relative to the ring bit, infiltration of the fluid to the surroundings of the borehole is more effectively prevented. That is, since the ring bit surrounds the entirety of the distal end portion of the inner bit, the fluid and the drill waste are prevented from leaking to the outside in the radial direction of the ring bit and are efficiently recovered into the discharge groove which is located on the inside in the radial direction of the ring bit.

In the drilling tool according to above aspect of the present invention, a plurality of tips protruding from the distal end surface of the inner bit may be disposed on the distal end surface of the inner bit; an outer peripheral edge portion in the distal end surface of the inner bit may be made as a gauge surface which gradually extends toward the base end side in the direction of the axial line and toward the outside in the radial direction in a longitudinal cross-sectional view of the drilling tool; the inside in the radial direction of the gauge surface in the distal end surface of the inner bit may be made as a face surface; and the amount of protrusion from the face surface of each of the tips disposed on the face surface among a plurality of the tips may be larger than the amount of protrusion from the gauge surface of each of the tips disposed on the gauge surface among a plurality of the tips.

In this case, a gap between the adjacent tips through which the fluid and the drill waste flow can be easily secured in the face surface of the distal end surface of the inner bit, and the fluid and the drill waste can be easily discharged toward the discharge groove through the gap.

In the drilling tool according to above aspect of the present invention, the distal end groove may gradually extend toward the side opposite to a tool rotation direction and toward the outside in the radial direction from the distal end blow hole.

In this case, since the distal end groove gradually extends toward the side opposite to the tool rotation direction and toward the outside in the radial direction from the distal end blow hole, it becomes difficult for the flow of the fluid and the drill waste flowing through the distal end groove to be inhibited by the rotation of the tool, and it becomes easy for the fluid and the drill waste to stably flow from the distal end groove into the discharge groove.

In the drilling tool according to above aspect of the present invention, the outer peripheral groove may gradually extend toward the base end side in the direction of the axial line and toward a rotation direction of the inner bit.

In this case, the fluid in the outer peripheral groove flows into the discharge groove, while forming a flow toward the base end side in the direction of the axial line from the outer peripheral blow hole to the discharge groove along with the rotation of the inner bit. Accordingly, it becomes easier for the fluid and the drill waste in the discharge groove to flow toward the base end side of the tool.

In the drilling tool according to above aspect of the present invention, the face surface may comprise: a first receding surface receding to the base end side in the direction of the axial line; and a second receding surface receding toward the base end side in the direction of the axial line relative to the first receding surface, and the amount of protrusion from the first receding surface of each of the tips disposed on the first receding surface among a plurality of the tips may be the same as the amount of protrusion from the second receding surface of each of the tips disposed on the second receding surface among a plurality of the tips.

In this case, since it is easy to secure a gap between the tips or the like in the first receding surface and the second receding surface, retention of the fluid and the drill waste in the face surface is effectively limited. Thus, discharge of the fluid and the drill waste is stably performed.

In the drilling tool according to above aspect of the present invention, the face surface may comprise: a first receding surface receding to the base end side in the direction of the axial line; and a second receding surface receding toward the base end side in the direction of the axial line relative to the first receding surface, and in the direction of the axial line, a position of a distal end of each of the tips disposed on the first receding surface among a plurality of the tips may be the same as a position of a distal end of each of the tips disposed on the second receding surface among a plurality of the tips.

In this case, the excavation efficiency of the tip in the second receding surface in which the amount of recession is large is not reduced.

Advantageous Effects of Invention

According to the aspect of the drilling tool in the present invention, the fluid ejected from the supply hole of the inner bit and the drill waste generated by excavation can be efficiently recovered into the discharge groove of the inner bit and can be stably discharged toward the base end side of the tool through the discharge groove. Thereby, it is possible to highly efficiently and stably proceed with drilling tasks and to limit the influence on the ground around the borehole.

DESCRIPTION OF EMBODIMENTS

Hereinafter, a drilling tool 1 according to an embodiment of the present invention will be described with reference to the drawings.

The drilling tool 1 of this embodiment has a double pipe type bit and is connected to a drilling apparatus (not shown) for excavating the ground to form a borehole while inserting a casing pipe 2 into the borehole.

Figure 1:
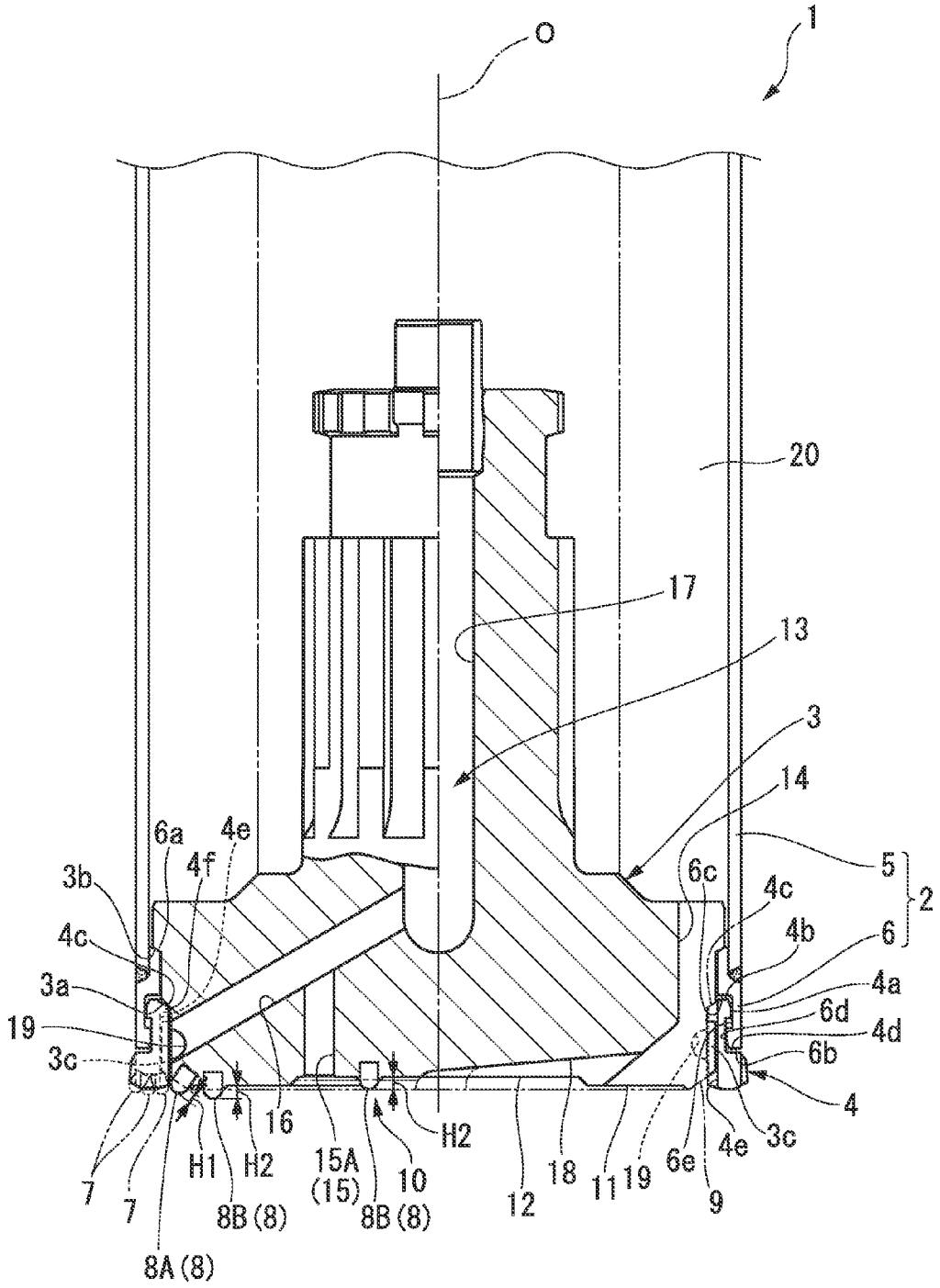
FIG. 1 is a cross-sectional side view (a longitudinal cross-sectional view) showing a drilling tool according to an embodiment of the present invention.

As shown in FIG. 1, the drilling tool 1 includes the casing pipe 2, an inner bit 3, and a ring bit 4. The casing pipe 2 has a cylindrical shape. The inner bit 3 is inserted into the casing pipe 2 in a direction of an axial line O thereof, and a distal end portion in the direction of the axial line O of the inner bit 3 protrudes from the distal end of the casing pipe 2. The ring bit 4 has an annular shape, is disposed at a distal end portion of the casing pipe 2 so as to be rotatable around the axial line O relative to the casing pipe 2, surrounds the distal end portion of the inner bit 3, and is capable of engaging with the inner bit 3 around the axial line O and from the distal end side in the direction of the axial line O.

Here, the casing pipe 2, the inner bit 3, and the ring bit 4 are disposed coaxially with each other with the axial line O as a common axial line. In this specification, the ring bit 4 side in the direction of the axial line O (the lower side in FIG. 1) is referred to as a distal end side, and the side opposite to the ring bit 4 in the direction of the axial line O (the upper side in FIG. 1) is referred to as a base end side. Further, a direction orthogonal to the axial line O is referred to as a radial direction, and a direction around the axial line O is referred to as a circumferential direction. In addition, a direction in which the inner bit 3 rotates relative to the casing pipe 2 during excavation, of the circumferential direction, is referred to as a tool rotation direction T (or the front in the tool rotation direction T), and a direction which is directed to the side opposite to the tool rotation direction T is referred to as the rear in the tool rotation direction T.

The casing pipe 2 has: a pipe main body 5 having a long cylindrical shape (circular pipe shape) and being sequentially added depending on a drilling length of the borehole; and a casing top 6 having a short cylindrical shape (annular shape) and being coaxially mounted on a distal end of the pipe main body 5 by welding or the like. Further, a transmission member such as an inner rod or the like (not shown), which transmits the striking force, the impelling force, and the rotating force, is inserted on the inside in the radial direction of the casing pipe 2 coaxially with the axial line O of the casing pipe 2. The transmission member is also sequentially added depending on the digging length of the borehole. Further, the most-rear end (an end portion on the base end side) of the transmission member is connected to the drilling apparatus which applies a rotating force around the axial line O and an impelling force toward the distal end side in the direction of the axial line O to the transmission member during excavation. Further, the ring bit 4 having a short cylindrical shape is mounted on a distal end of the casing top 6 of the distal end of the casing pipe 2. The inner bit 3 is mounted on a distal end of the transmission member through a hammer (not shown) which applies striking force toward the distal end side in the direction of the axial line O, and is inserted on the inside in the radial direction of the ring bit 4.

In the casing top 6, both the inner diameter and the outer diameter of a base end-side portion thereof are smaller than those of a distal end-side portion. An end surface which is located on the most base end side in the casing top 6 and faces the base end side is made so as to be a tapered surface 6*a* which is gradually inclined toward the base end side toward the outside in the radial direction.

The casing top 6 is mounted on the pipe main body 5 by welding a base end of the distal end-side portion to the distal end of the pipe main body 5 to be abutted with each other, in a state where the base end-side portion of the casing top 6 is fitted onto and inserted through the inside in the radial direction of the most distal end portion in the pipe main body 5.

Further, the distal end-side portion of the casing top 6 has: an outer diameter approximately equal to the outer diameter of the pipe main body 5; and an inner diameter slightly larger than the inner diameter of the pipe main body 5. Further, a surface facing the distal end side in the direction of the axial line O in a distal end portion of the casing top 6, that is, both a distal end surface 6*b* of the casing top 6 and a stepped surface 6*c* facing the distal end side in the direction of the axial line O in a stepped portion between a distal end-side portion and a base end-side portion of the inner peripheral surface of the casing top 6 are annular flat surfaces perpendicular to the axial line O. Further, a ridge 6*d* protruding toward the inside in the radial direction and extending in the circumferential direction is formed at the distal end portion of the casing top 6. Thereby, a recessed groove 6*e* which is recessed to the outside in the radial direction and extends in the circumferential direction is formed between the ridge 6*d* and the stepped surface 6*c* in the inner peripheral surface of the casing top 6.

In the ring bit 4 which is mounted on the distal end side of the casing top 6, the outer peripheral surface of a base end portion thereof has a small outer diameter so as to be approximately fitted onto or loosely inserted through the inner peripheral surface of the distal end-side portion of the casing top 6. A distal end portion of the ring bit 4 has a diameter expanded to the outside in the radial direction so as to be larger than the outer diameter of the casing top 6 or the pipe main body 5. Specifically, a ridge 4*a* protruding toward the outside in the radial direction and extending along the circumferential direction is formed at the base end portion of the ring bit 4. The ridge 4*a* engages with the recessed groove 6*e* of the casing top 6, whereby the ring bit 4 is made so as to be rotatable in the circumferential direction while being prevented from slipping out toward the distal end side of the casing top 6.

Further, the inner peripheral surface of the ring bit 4 is formed so as to have a smaller inner diameter than the inner peripheral surface of the base end-side portion of the casing top 6. A tapered surface 4*c* which is gradually inclined toward the distal end side and toward the inside in the radial direction is formed on the end surface (a base end surface 4*b*) of the ring bit 4 facing the base end side. Therefore, in this embodiment, the outer peripheral surface (the ridge 4*a*) of the base end portion of the ring bit 4 is fitted onto and inserted through the inner peripheral surface (the recessed groove 6*e*) of the distal end-side portion of the casing top 6 of the distal end of the casing pipe 2, so that the outer peripheral surface faces the inner peripheral surface in the radial direction. The distal end surface 6*b* facing the distal end side in the direction of the axial line O of the distal end portion of the casing top 6 and a stepped surface 4*d* facing the base end side in the diameter-expanded distal end portion of the ring bit 4 are mounted so as to face each other in the direction of the axial line O, and the base end surface 4*b* of the ring bit 4 and the stepped surface 6*c* of the casing top 6 are mounted to face each other in the direction of the axial line O.

Further, the distal end surface of the ring bit 4 includes a flat annular surface perpendicular to the axial line O, and two tapered surfaces which are respectively connected to the radially inner side and the radially outer side of the annular surface and are inclined to the base end side as they go toward the inside and the outside in the radial direction. A plurality of tips 7 made of a hard material such as cemented carbide are disposed on each of the annular surface and the tapered surfaces on the inside and the outside in the radial direction.

Further, on the inner peripheral surface of the ring bit 4, a plurality of recessed grooves 4*e* extending parallel to the axial line O are formed at intervals in the circumferential direction so as not to interfere with the tips 7 implanted in the tapered surface on the inside in the radial direction in the distal end of the ring bit 4. A rear portion of each of the recessed grooves 4*e* in the tool rotation direction T at the time of excavation, penetrates the ring bit 4 from the tapered surface on the inside of the distal end thereof in the radial direction to the tapered surface 4*c*, as in the recessed groove 4*e* shown on the right side of FIG. 1, while a front portion of the recessed grooves 4*e* in the tool rotation direction T is not open in the tapered surface 4*c* by a wall portion 4*f* shown on the left side of FIG. 1 which is formed at the base end side thereof like the recessed groove 4*e*.

The inner bit 3 has a multi-stage columnar shape which is expanded in diameter in two stages and then reduced in diameter in a stepwise fashion toward the base end side from the distal end. The inner bit 3 has: the outer diameter of a first stage portion on the distal end side of the inner bit 3 so as to be capable of being loosely inserted through the inside in the radial direction of the ring bit 4; the outer diameter of a second stage portion so as to be capable of being loosely inserted through the inside in the radial direction of the base end-side portion of the casing top 6; and the outer diameter of a largest third stage portion so as to be capable of being loosely inserted through the inside in the radial direction of the pipe main body 5.

Further, each of an outer peripheral edge portion of the distal end surface of the first stage portion of the inner bit 3 (that is, an outer peripheral edge portion of the distal end surface of the inner bit 3), a stepped portion between the first stage and the second stage, and a stepped portion between the second stage and the third stage is made so as to be a tapered surface conically spreading toward the base end side and toward the outside in the radial direction. A tapered surface 3*a* between the first stage and the second stage and a tapered surface 3*b* between the second stage and the third stage have a taper angle equal to the taper angles of the tapered surface 4*c* of the ring bit 4 and the tapered surface 6*a* of the casing top 6. As shown in FIG. 1, the ring bit 4 is disposed in such a manner that the position of the distal end surface of the ring bit 4 is the same as the position of the distal end surface of the inner bit 3 in the direction of the axial line O, in a state where the tapered surfaces 3*a* and 3*b* come into contact with the tapered surfaces 4*c* and 6*a*.

Specifically, in this embodiment, in FIGS. 1 and 5, the position of the annular surface which is the most distal portion of the distal end surface of the ring bit 4 is the same as the position of an outer peripheral edge of a face surface 10 (described later) which is a portion (the most distal portion) located on the most distal end side of the distal end surface of the inner bit 3 (in other words, in FIG. 1, an annular surface which is located between a first receding surface 11 of the face surface 10 and a gauge surface 9), in the direction of the axial line O.

At the outer periphery of the first stage portion of the inner bit 3, a plurality of ridges 3*c* protruding further toward the outside in the radial direction relative to the outer diameter of the outer periphery capable of being loosely inserted through the inside in the radial direction of the ring bit 4, as described above, are formed to extend in the direction of the axial line O and at intervals in the circumferential direction. The number of ridges 3*c* is the same as the number of recessed grooves 4*e*, and each of the ridge 3*c* is provided to extend from the outer peripheral edge portion of the distal end surface of the inner bit 3 to a front portion of (a portion slightly separated toward the distal end side from) the tapered surface 3*a* in the direction of the axial line O.

The ridges 3*c* are capable of being loosely inserted from the base end side into penetration portions of the recessed grooves 4*e* penetrating to the tapered surface 4*c*, as shown in the right side of FIG. 1. By loosely inserting the ridges 3*c* into the recessed grooves 4*e* in this manner and bringing the tapered surfaces 4*c* and 6*a* into contact with the tapered surfaces 3*a* and 3*b* as described above, the ridges 3*c* are capable of being accommodated with a distance therebetween in the recessed grooves 4*e* further toward the distal end sides of the recessed grooves 4*e* relative to the wall portion 4*f*, as shown in the left side of FIG. 1.

Therefore, the inner bit 3 inserted through the inside in the radial direction of the ring bit 4 with the ridges 3*c* accommodated in the recessed grooves 4*e* is capable of engaging with the ring bit 4 from the base end side in the direction of the axial line O by bringing the tapered surface 3*a* into contact with the tapered surface 4*c* (be capable of being engaged so as to be prevented from slipping out toward the distal end side). In addition to this, by the contact of each of the ridges 3*c* with either of side walls facing in the circumferential direction of each of the recessed grooves 4*e* at the time of rotation around the axial line O, the inner bit 3 is capable of engaging with the ring bit 4 around the axial line O and being rotated integrally with the ring bit 4.

Figure 2:
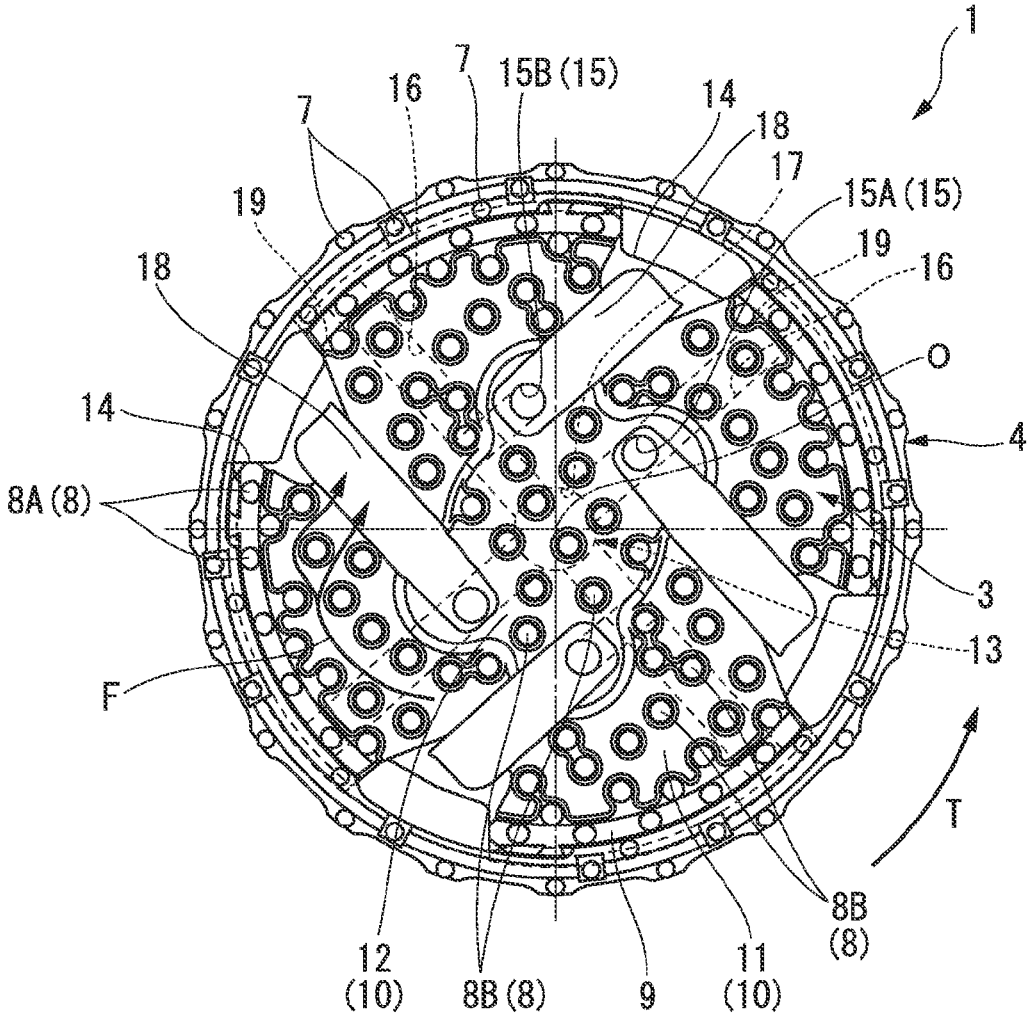
FIG. 2 is a front view of the drilling tool of FIG. 1 as viewed from the distal end side of the tool.

On the distal end surface of the inner bit 3, a plurality of tips 8 protruding from the distal end surface are disposed (implanted). The outer peripheral edge portion in the distal end surface of the inner bit 3 is the gauge surface 9 extending toward the outside in the radial direction so as to become gradually closer to the base end side, as seen in a longitudinal cross-sectional view of the drilling tool 1 shown in FIG. 1. Further, as shown in FIGS. 1 and 2, a site on the inside in the radial direction of the gauge surface 9 (a site other than the gauge surface 9, of the distal end surface) in the distal end surface of the inner bit 3 is the face surface 10. The face surface 10 is receded in a stepwise fashion toward the inside in the radial direction from the gauge surface 9. Specifically, the face surface 10 of the inner bit 3 has: the first receding surface 11 adjacent to the inside in the radial direction of the gauge surface 9 and receding toward the base end side by one step; and a second receding surface 12 located on the inside in the radial direction of the first receding surface 11, receding further toward the base end side relative to the first receding surface 11 by one step, and including the axial line O (a central portion in the radial direction).

In the example shown in FIG. 1, the amount of recession at which the second receding surface 12 recedes to the base end side relative to the first receding surface 11 is set to be larger than the amount of recession at which the first receding surface 11 recedes to the base end side relative to the outer peripheral edge which is located on the most distal end side of the face surface 10.

In this embodiment, the tip 8 is a rounded button tip formed such that a distal end portion thereof has a hemispherical shape and a site except for the distal end portion has a columnar shape. Further, among a plurality of the tips 8, tips 8A disposed on the gauge surface 9 and tips 8B disposed on the face surface 10 have the same shape as each other.

In a plurality of the tips 8, the amount of protrusion H2 from the face surface 10, of each of the tips 8B disposed on the face surface 10, provided to protrude on the distal end surface of the inner bit 3, is set to be larger than the amount of protrusion H1 from the gauge surface 9, of each of the tips 8A disposed on the gauge surface 9.

In the example shown in FIG. 1, a distal end of the tip 8B is disposed toward the distal end side relative to the position of a distal end of the tip 8A in the direction of the axial line O.

Figure 3:
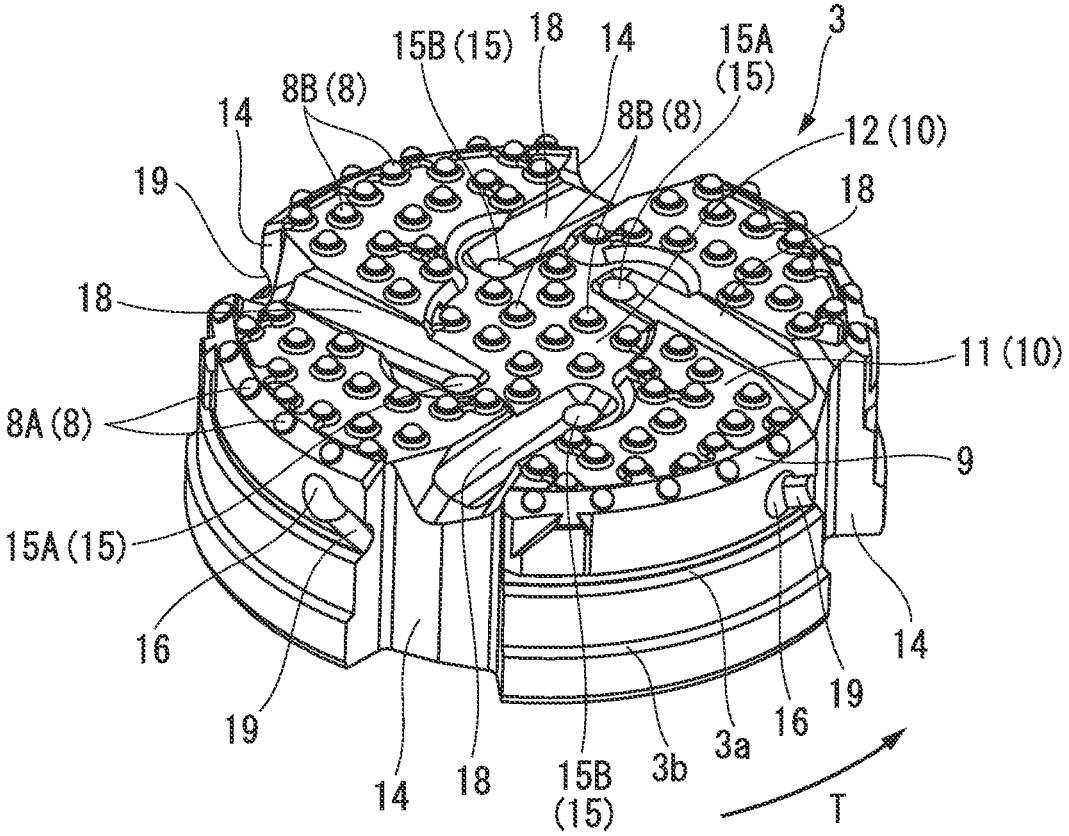
FIG. 3 is a perspective view showing a main section of an inner bit in the drilling tool of FIG. 1.

In FIG. 3, on the face surface 10, a plurality of tip support portions each having an annular shape to support the outer peripheral surface of each of the tips 8B are provided. The tip support portions are provided to protrude from the face surface 10 so as to follow the outer peripheral surfaces of the respective tips 8B.

Further, as shown in FIG. 1, in the first receding surface 11 and the second receding surface 12 provided in the face surface 10, the amount of protrusion H2 at which each of the tips 8B of the first receding surface 11 protrudes toward the distal end side from the first receding surface 11 is the same as the amount of protrusion H2 at which each of the tips 8B of the second receding surface 12 protrudes toward the distal end side from the second receding surface 12.

Therefore, the distal end of the tip 8B disposed on the first receding surface 11 of the face surface 10 is disposed further toward the distal end side relative to the position in the distal end of the tip 8B disposed on the second receding surface 12 in the direction of the axial line O.

Further, in FIG. 2, a plurality of the tips 8B disposed on the first receding surface 11 are arranged in a substantially circular-arc shape so as to follow the circumferential direction, and a plurality of such rows are formed at intervals in the radial direction. Specifically, the tips 8B which form rows in the circumferential direction are arranged in the circumferential direction while making the positions in the radial direction slightly different from each other. A distal end groove 18 (described later) is disposed at the rear in the tool rotation direction T of the rows.

In FIG. 1, the inner bit 3 has: a supply hole 13 which passes through the inner bit 3 and is open at the distal end portion of the inner bit 3; and a discharge groove 14 which is formed in the outer peripheral surface of the inner bit 3 and extends in the direction of the axial line O.

Further, the supply hole 13 has: a distal end blow hole 15 which is open in the distal end surface in the distal end portion of the inner bit 3; an outer peripheral blow hole 16 which is open in the outer peripheral surface in the distal end portion of the inner bit 3; and a communication hole 17 which communicates with the base end sides of the distal end blow hole 15 and the outer peripheral blow hole 16, thereby making a fluid flow toward the holes 15 and 16.

Specifically, the diameter-reduced portion further toward the base end side relative to the third stage in the inner bit 3 is made so as to be a mounting portion on the hammer. The communication hole 17 which receives a fluid such as compressed air (air) supplied from the hammer is formed from the base end of inner bit 3 toward the distal end side in the axial line O inside the inner bit 3. The communication hole 17 is branched into a plurality of the outer peripheral blow holes 16 extending to the distal end side as they go toward the outside in the radial direction, at the distal end portion of the inner bit 3. The distal end blow hole 15 is branched toward the distal end surface of the inner bit 3 from an intermediate site which is located between both end portions of each of the outer peripheral blow holes 16.

In the supply hole 13, the inner diameter is reduced in the order of the communication hole 17, the outer peripheral blow hole 16, and the distal end blow hole 15.

In a front view shown in FIG. 2, a plurality of the outer peripheral blow holes 16 are branched from the communication hole 17 so as to form a radial shape with the axial line O as the center.

In FIGS. 1 and 2, a plurality of the distal end blow holes 15 are open in the distal end surface of the inner bit 3, and at least one of the distal end blow holes 15 is a distal end blow hole 15A extending so as to be parallel to the axial line O. In this embodiment, the distal end blow holes 15A are half or more of a plurality of the distal end blow holes 15 formed in the distal end portion of the inner bit 3, and specifically, two out of four distal end blow holes 15 are the distal end blow holes 15A. Further, a distal end blow hole 15B which is a distal end blow hole other than the distal end blow hole 15A is included in the distal end blow holes 15, the distal end blow hole 15B extending toward the rear in the tool rotation direction T so as to become gradually closer to the distal end side. In addition, the distal end blow hole 15B extends toward the distal end side so as to be gradually slightly separated from the axial line.

Further, in the outer periphery of the inner bit 3, a plurality of the discharge grooves 14 configured to discharge drill waste extending parallel to the axial line O are formed over an area from the distal end of the inner bit 3 to the third stage having the maximum outer diameter. The discharge grooves 14 are disposed so as not to interfere with the ridges 3*c* in the circumferential direction. The discharge grooves 14 are covered with the casing pipe 2 and the ring bit 4 from the outside in the radial direction. The end portions on the distal end side of the discharge grooves 14 are open in the distal end surface of the inner bit 3. Further, a discharge passage 20 through which the fluid and the drill waste flow toward the base end side between the transmission member and the casing pipe 2 is formed on the base end side of the discharge groove 14.

Then, in FIGS. 2 and 3, an outer peripheral groove 19 through which the outer peripheral blow hole 16 and the discharge groove 14 communicate with each other is formed in the outer peripheral surface of the inner bit 3.

Further, the distal end blow hole 15 is open into the distal end groove 18 which is formed in the distal end surface of the inner bit 3 and communicates with the discharge groove 14. The outer peripheral blow hole 16 is open into the outer peripheral groove 19 which is formed in the outer peripheral surface of the inner bit 3 and communicates with the discharge groove 14.

In this embodiment, the distal end blow hole 15 is open in the second receding surface 12 of the face surface 10, and the distal end groove 18 extends from the second receding surface 12 to the discharge groove 14. Specifically, in the front view shown in FIG. 2, the distal end groove 18 extends toward the outside in the radial direction from the distal end blow hole 15 so as to become gradually closer the rear in the tool rotation direction T. Then, the distal end blow hole 15 is open at the end portion on the inside in the radial direction in the distal end groove 18, and the end portion on the outside in the radial direction is connected to the discharge groove 14. Further, in the illustrated example, the groove width of the distal end groove 18 is made to be larger than the inner diameter of the distal end blow hole 15. The cross-sectional shape along a groove width direction of the distal end groove 18 is a substantially semicircular arc shape.

In the longitudinal cross-sectional view shown in FIG. 1, a groove depth of the distal end groove 18 in the direction of the axial line O gradually increases toward the discharge groove 14 from the distal end blow hole 15. A connection portion to the discharge groove 14 in a groove bottom of the distal end groove 18 is cut out in a chamfered shape. Further, in the front view shown in FIG. 2, the groove width of the distal end groove 18 is made to be substantially constant from the distal end blow hole 15 to the connection portion, and in the connection portion, the groove width is made so as to gradually increase toward the discharge groove 14 on the outside in the radial direction.

As shown in FIG. 1, the outer peripheral groove 19 is covered with the ring bit 4 from the outside in the radial direction. Further, as shown in FIG. 3, the outer peripheral groove 19 extends toward the discharge groove 14 from the outer peripheral blow hole 16 so as to become gradually closer to the base end side toward the front in the circumferential direction. In this embodiment, the outer peripheral groove 19 extends to be inclined toward the tool rotation direction T so as to become gradually closer to the base end side. The outer peripheral blow hole 16 is open at the end portion of the outer peripheral groove 19 in the rear in the tool rotation direction T, and the end portion of the outer peripheral groove 19 in the front in the tool rotation direction T is connected to the discharge groove 14. Further, in the illustrated example, the groove width of the outer peripheral groove 19 is made to be smaller than the inner diameter of the outer peripheral blow hole 16. The cross-sectional shape along a groove width direction of the outer peripheral groove 19 is a substantially semicircular arc shape.

In the drilling tool 1 of this embodiment described above, an impelling force and striking force toward the distal end side in the direction of the axial line O and a rotating force around the axial line O are applied to the inner bit 3. Thereby, the inner bit 3 and the ring bit 4 engaging therewith excavates the ground to form a borehole, while the casing pipe 2 is inserted (drawn) into the borehole. Further, along with the excavation, a fluid (an ejection medium) such as air is ejected onto the distal end surface of the inner bit 3 through the supply hole 13, while the fluid and the drill waste (a slime) generated by the excavation are discharged toward the base end side of the tool through the discharge groove 14.

According to the drilling tool 1 of this embodiment, the outer peripheral blow hole 16 of the supply hole 13 communicates with the discharge groove 14 through the outer peripheral groove 19 formed in the outer peripheral surface of the inner bit 3. The outer peripheral groove 19 is covered with the ring bit 4 from the outside in the radial direction and extends toward the discharge groove 14 from the outer peripheral blow hole 16 so as to become gradually closer to the base end side in the direction of the axial line O around the axial line O. Therefore, the following operation and effects are exhibited.

That is, the fluid in the outer peripheral groove 19 flows into the discharge groove 14, while forming a flow toward the base end side in the direction of the axial line O from the outer peripheral blow hole 16 to the discharge groove 14. Therefore, it becomes easier for the fluid and the drill waste in the discharge groove 14 to flow toward the base end side of the tool.

Further, since the outer peripheral groove 19 is covered with the ring bit 4 from the outside thereof in the radial direction, the fluid ejected from the outer peripheral blow hole 16 into the outer peripheral groove 19 is efficiently sent toward the discharge groove 14 while being prevented from infiltrating into the ground. Therefore, the recovery efficiency of the fluid and the drill waste flowing through the discharge groove 14 is improved.

In addition, since the outer peripheral groove 19 is covered with the ring bit 4, infiltration of the drill waste into the outer peripheral groove 19 is limited, and thus the outer peripheral groove 19 is prevented from being clogged with the drill waste. In addition to this, a flow path in the outer peripheral groove 19 is stably secured, and thus the flow velocity of the fluid flowing through the outer peripheral groove 19 is stably maintained. Thereby, also in the discharge groove 14 into which the fluid flows from the outer peripheral groove 19, the flow velocity of the fluid and the drill waste flowing through the inside of the discharged groove is quickened. As a result, due to the Venturi effect, the pressure in the discharge groove 14 becomes lower than the pressure in the distal end groove 18 (including the surroundings thereof) which is open in the distal end surface of the inner bit 3, whereby the fluid and the drill waste in the distal end groove 18 are easily drawn into the discharge groove 14 having a lower pressure and is easily sent to the discharge passage 20 on the base end side of the tool through the discharge groove 14.

In this manner, according to this embodiment, the fluid ejected from the supply hole 13 of the inner bit 3 and the drill waste generated by excavation can be efficiently recovered into the discharge groove 14 of the inner bit 3 and can be stably discharged toward the base end side of the tool through the discharge groove 14. Thereby, it is possible to highly efficiently and stably proceed with drilling tasks and to limit the influence on the ground around the borehole.

Further, the distal end blow hole 15 is open into the distal end groove 18 which is formed in the distal end surface of the inner bit 3 and communicates with the discharge groove 14. The outer peripheral blow hole 16 is open into the outer peripheral groove 19 which is formed in the outer peripheral surface of the inner bit 3 and communicates with the discharge groove 14. Therefore, the following effects are exhibited.

That is, the fluid ejected from the distal end blow hole 15 is efficiently guided into the discharge groove 14 through the distal end groove 18 together with the drill waste around the distal end surface of the inner bit 3. Thereby, efficiency in recovering the fluid and the drill waste is increased. Further, since the outer peripheral blow hole 16 is directly open into the outer peripheral groove 19, the above-described operation and effects become more remarkable.

Further, since at least one of a plurality of the distal end blow holes 15 which are open in the distal end surface of the inner bit 3 is the distal end blow hole 15A extending so as to be parallel to the axial line O, the fluid ejected from the distal end blow hole 15A can be prevented from escaping toward the outer periphery side from the distal end surface of the inner bit 3. Thereby, the ground around the borehole can be efficiently prevented from becoming loose. Further, the fluid ejected from the distal end blow hole 15A easily spreads over the entirety of the distal end surface of the inner bit 3, and thus excavation efficiency is further increased.

Further, it becomes easy to secure a large distance along the radial direction from a portion in which the distal end blow hole 15A is open in the distal end surface of the inner bit 3 (in this embodiment, into the distal end groove 18) to the discharge groove 14 of the outer peripheral surface of the inner bit 3. Therefore, efficiency in recovering the drill waste through the distal end groove 18 is improved.

In addition, in this embodiment, since the distal end blow holes 15A are half or more of all the distal end blow holes 15, it becomes easy for the above-described effects to be more remarkably obtained.

Further, the ring bit 4 is disposed in such a manner that the position of the distal end surface thereof is the same as the position of the distal end surface of the inner bit 3 in the direction of the axial line O. Specifically, in this embodiment, the position of the annular surface which is the most distal portion in the distal end surface of the ring bit 4 is the same as the position of the outer peripheral edge of the face surface 10 which is the most distal portion in the distal end surface of the inner bit 3 in the direction of the axial line O. That is, since the inner bit 3 does not protrude toward the distal end side of the tool relative to the ring bit 4, infiltration of the fluid to the surroundings of the borehole is more effectively prevented. That is, since the ring bit 4 surrounds the entirety of the distal end portion of the inner bit 3, the fluid and the drill waste are prevented from leaking to the outside in the radial direction of the ring bit 4 and are efficiently recovered into the discharge groove 14 which is located on the inside in the radial direction of the ring bit 4.

Further, among a plurality of the tips 8 provided to protrude on the distal end surface of the inner bit 3, the amount of protrusion H2 from the face surface 10 of each of the tips 8B disposed on the face surface 10, is larger than the amount of protrusion H1 from the gauge surface 9 of each of the tips 8A disposed on the gauge surface 9. Therefore, a gap between the adjacent tips 8B through which the fluid and the drill waste flow is easily secured in the face surface 10, and the fluid and the drill waste can be easily discharged toward the distal end groove 18 and the discharge groove 14 through the gap.

In this embodiment, the tip support portion having an annular shape is provided to protrude on the face surface 10 to support the outer peripheral surface of each of the tips 8B. Thereby, it is possible to secure the amount of protrusion H2 while the mounting posture of the tip 8B with respect to the face surface 10 is stabilized and mounting strength is also increased. Further, it is possible to use, as the tips 8A and 8B, the same member while securing the amount of protrusion H2 of the tip 8B of the face surface 10 in this manner. Therefore, it is possible to reduce the number of types of parts.

In this embodiment, the first receding surface 11 and the second receding surface 12 which recedes in a stepwise fashion toward the central portion (in the vicinity of the axial line O) in the radial direction from the outer peripheral edge of the face surface 10 are formed, and it is easy to secure a gap between the tips 8B or the like in the first receding surface 11 and the second receding surface 12. Therefore, retention of the fluid and the drill waste in the face surface 10 is effectively limited. Thus, discharge of the fluid and the drill waste is stably performed. In particular, the amount of recession of the second receding surface 12 which is located at the central portion in the radial direction of the face surface 10 is secured in a large amount, whereby it becomes easy for the above-described effects to be more remarkably obtained.

Unlike in this embodiment, the position of the distal end of each of the tips 8B disposed on the first receding surface 11 may be substantially the same as the position in the distal end of each of the tips 8B disposed on the second receding surface 12 in the direction of the axial line O. In this case, it becomes possible to obtain the above-described effects without reducing the excavation efficiency of the tip 8B in the second receding surface 12 in which the amount of recession is larger.

A plurality of the tips 8B in the face surface 10 are arranged so as to follow the circumferential direction, and a plurality of such rows are provided at intervals in the radial direction. Therefore, it becomes easy to create the flow of the fluid and the drill waste, for example, as shown by an arrow F in FIG. 2, and the fluid and the drill waste are easily guided into the distal end groove 18 along the array of the tips 8B. Thus, discharge efficiency is increased.

The distal end groove 18 extends toward the outside in the radial direction from the distal end blow hole 15 so as to become gradually closer to the side opposite to the tool rotation direction T (the rear in the tool rotation direction T). Therefore, the following effects are exhibited.

That is, since the distal end groove 18 extends toward the outside in the radial direction from the distal end blow hole 15 so as to become gradually closer to the rear in the tool rotation direction T, it becomes difficult for the flow of the fluid and the drill waste flowing through the distal end groove 18 to be inhibited by the rotation of the tool. Therefore, it becomes easy for the fluid and the drill waste to stably flow from the distal end groove 18 into the discharge groove 14.

Here, the present invention is not limited to the embodiment described above, and it is possible to add various changes to the embodiment within a scope which does not depart from the gist of the present invention.

For example, in the embodiment described above, in FIG. 1, the ring bit 4 is disposed in such a manner that the position of the distal end surface thereof is the same as the position of the distal end surface of the inner bit 3 in the direction of the axial line O. However, there is no limitation thereto.

Figure 4:
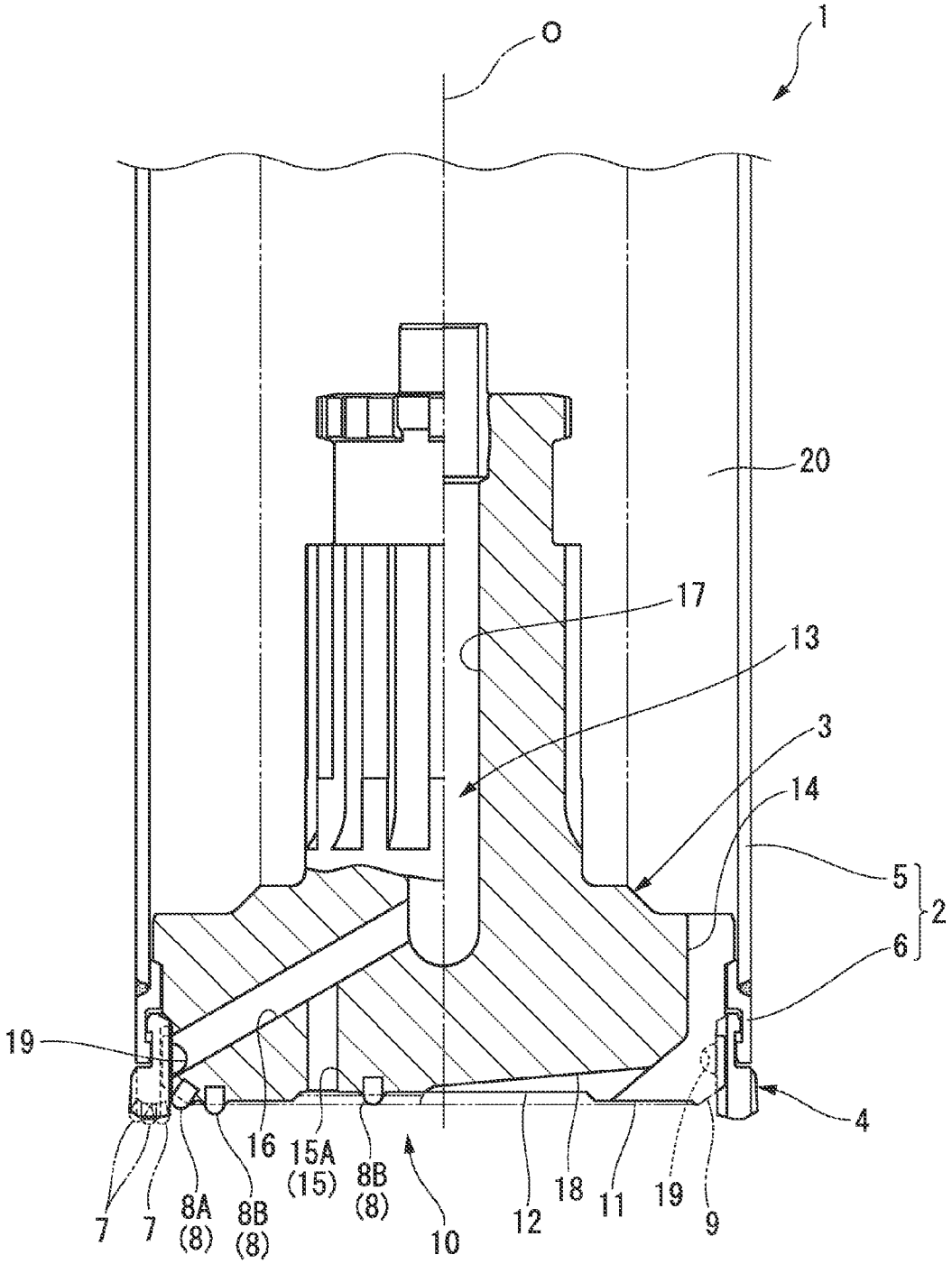
FIG. 4 is a cross-sectional side view showing a modified example of the drilling tool.

Here, FIG. 4 shows a modified example of the drilling tool 1 described in the above-described embodiment. In this modified example, the ring bit is disposed in such a manner that the distal end surface of the ring bit 4 protrudes relative to the distal end surface of the inner bit 3 toward the distal end side in the direction of the axial line O. Specifically, the position of the annular surface which is the most distal portion of the distal end surface of the ring bit 4 protrudes toward the distal end side of the tool relative to the outer peripheral edge of the face surface 10 which is the most distal portion of the distal end surface of the inner bit 3 in the direction of the axial line O. Also in this modified example, similarly to the embodiment described above, the ring bit 4 surrounds the entirety of the distal end portion of the inner bit 3. Therefore, infiltration of the fluid to the surroundings of the borehole is limited and the fluid and the drill waste are efficiently recovered into the discharge groove 14 which is located on the inside in the radial direction of the ring bit 4.

Here, the expression "in the direction of the axial line O, the distal end surface of the ring bit 4 is disposed at the same position as the distal end surface of the inner bit 3 or disposed so as to protrude toward the distal end side of the tool relative to the distal end surface of the inner bit 3" as referred to in this specification represents that there is in a state where the ring bit 4 substantially surrounds the distal end portion of the inner bit 3 so as to obtain the above-described effects, and does not necessarily refer to only the relative positional relationship between the most distal portion in the distal end surface of the inner bit 3 and the most distal portion in the distal end surface of the ring bit 4.

Further, the term "distal end surface" is a concept that also includes, for example, a ridgeline portion at which two surfaces intersect each other. That is, in the above-described embodiment, the annular surface perpendicular to the axial line O, and the two tapered surfaces on the inside and the outside in the radial direction of the annular surface are formed on the distal end surface of the ring bit 4. However, in a case where the annular surface is not formed and a ridgeline portion at which two tapered surfaces intersect each other is formed, the ring bit 4 is disposed in such a manner that the position of the ridgeline portion in the distal end surface of the ring bit 4 is the same as or protrudes toward the distal end side relative to the distal end surface of the inner bit 3 in the direction of the axial line O.

In the embodiment described above, in the face surface 10 of the inner bit 3, the distal end of each of the tip 8B disposed on the first receding surface 11 is disposed further toward the distal end side relative to the position in the distal end of the tip 8B disposed on the second receding surface 12 in the direction of the axial line O. However, there is no limitation thereto. As described above, the positions of the distal ends of the tips 8B of the first and second receding surfaces 11 and 12 may be set to be the same as each other, and alternatively, the distal end of the tip 8B disposed on the first receding surface 11 may be receded further toward the base end side relative to the distal end of the tip 8B disposed on the second receding surface 12.

Further, the first and second receding surfaces 11 and 12 are formed in the face surface 10. However, either or both of the first and second receding surfaces 11 and 12 may not be formed. That is, in the above-described embodiment, the face surface 10 has been described as receding in a stepwise fashion toward the inside in the radial direction from the gauge surface 9. However, there is no limitation thereto. For example, the face surface 10 may recede by only one step, or the entirety of the face surface 10 may be a flat and smooth surface without being receded.

Figure 5:
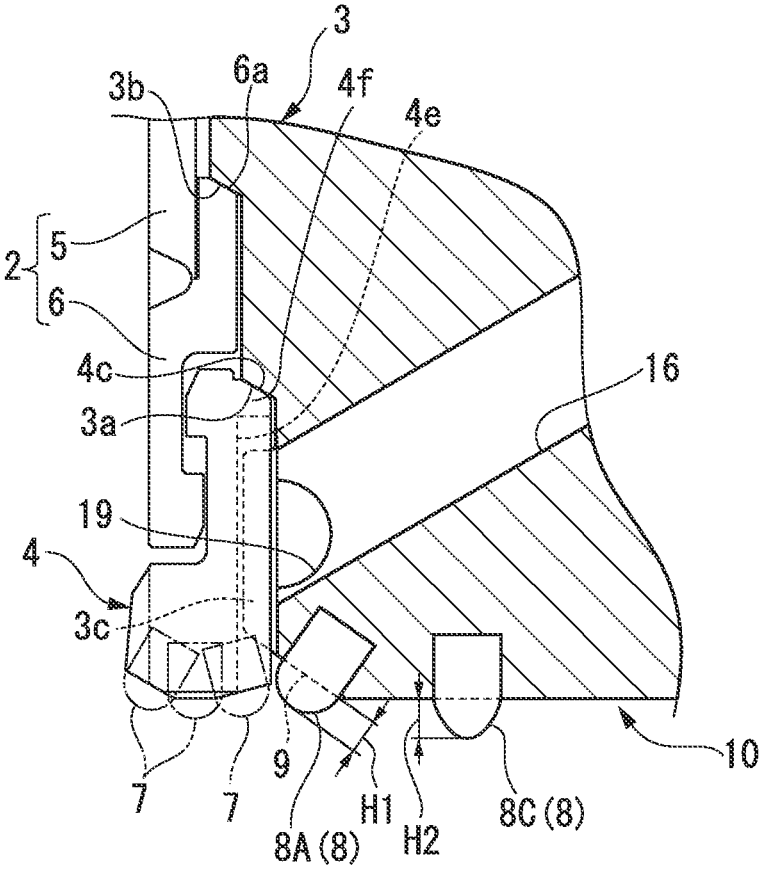
FIG. 5 is an enlarged view showing a modified example of the drilling tool.
Figure 6:
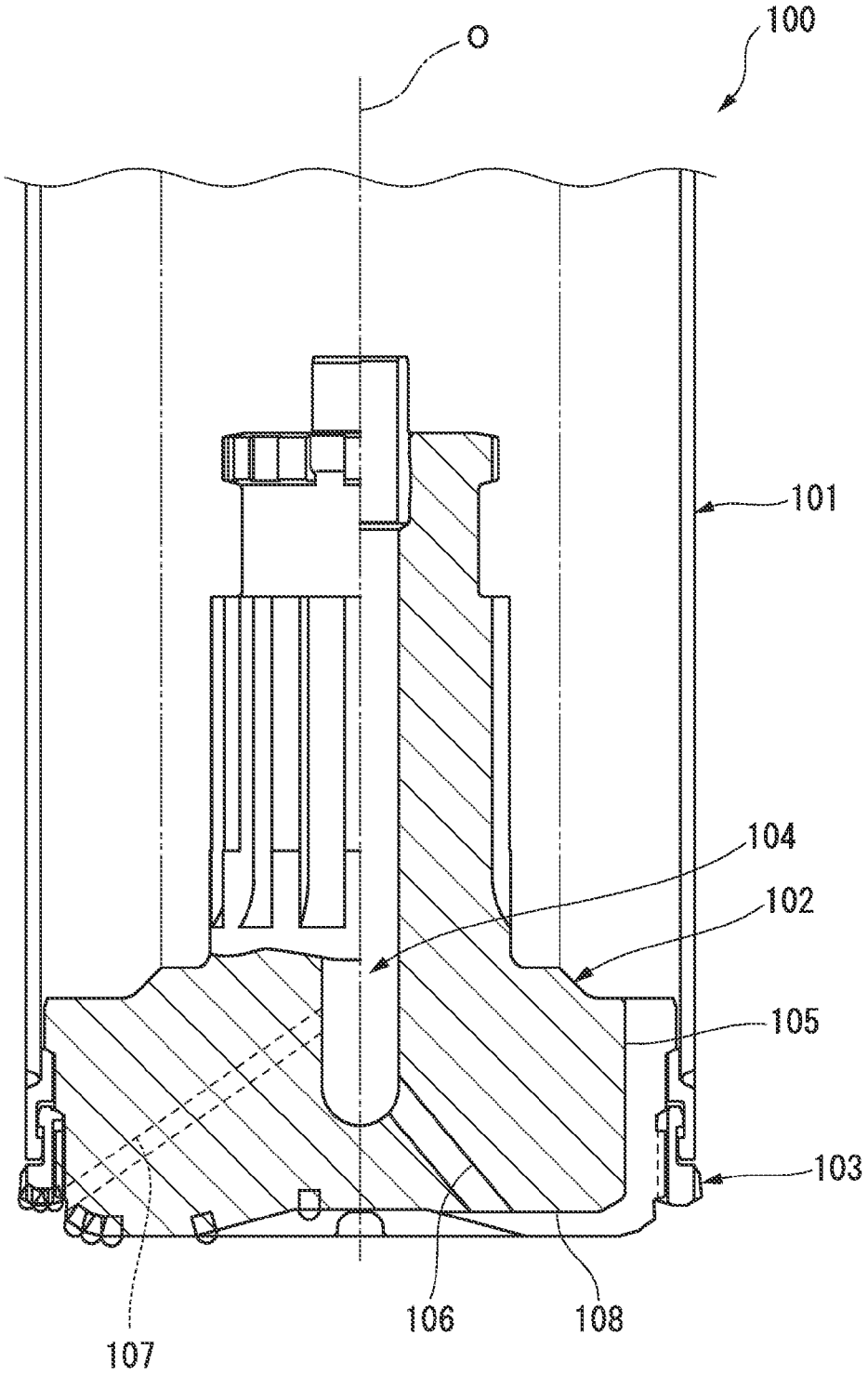
FIG. 6 is a cross-sectional side view showing a conventional drilling tool.
Figure 7:
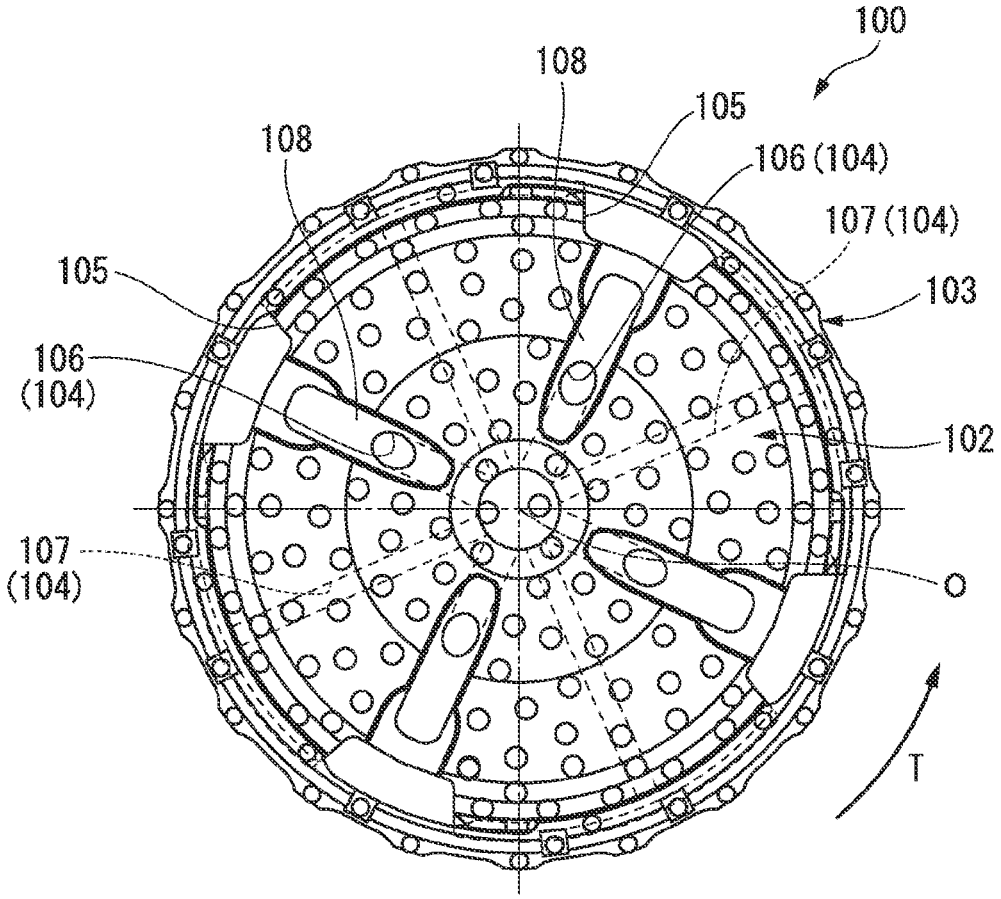
FIG. 7 is a front view of the drilling tool of FIG. 6 as viewed from the distal end side.

More specifically, as shown in a modified example of FIG. 5, the first and second receding surfaces 11 and 12 may not be formed in the face surface 10, the face surface 10 may be a flat and smooth surface, and a tip 8C (8) composed of a ballistic-shaped (cannonball-shaped) button tip may be implanted in the face surface 10, thereby securing the amount of protrusion H2. That is, in the tip 8C, the length of a distal end portion thereof (the length in a direction of a central axial line of the tips) is longer than the tips 8A and 8B described above. Therefore, it is easy to secure the amount of protrusion H2 at which the tip 8C protrudes from the face surface 10. Further, according to this configuration, it is possible to stabilize the mounting posture of the tip 8C without providing a tip support portion on the face surface 10, and mounting strength is also secured, and the manufacturing of the face surface 10 is easy.

The communication hole 17 of the supply hole 13 is branched into a plurality of the outer peripheral blow holes 16 at the distal end portion of the inner bit 3, and each of the outer peripheral blow holes 16 is branched into the distal end blow holes 15. However, there is no limitation thereto. That is, it is enough if the supply hole 13 has the distal end blow hole 15 which is open in the distal end surface of the inner bit 3 and the outer peripheral blow hole 16 which is open in the outer peripheral surface of the inner bit 3, and for example, the distal end blow hole 15 may be directly branched from the communication hole 17.

The distal end blow hole 15A extends so as to be parallel to the axial line O. However, there is no limitation thereto. That is, the distal end blow hole 15A may extend so as to gradually approach the axial line O toward the distal end side. Also in this case, the fluid ejected from the distal end blow hole 15A can be prevented from escaping toward the outer periphery side from the distal end surface of the inner bit 3. Thereby, the ground around the borehole can be effectively prevented from becoming loose. Further, it becomes easy for the fluid to spread over the entirety of the distal end surface of the inner bit 3, and thus excavation efficiency is increased. Further, it becomes easy to secure a large distance in the radial direction between a portion in which the distal end blow hole 15A is open in the distal end surface of the inner bit 3 (into the distal end groove 18) and the discharge groove 14 on the outer peripheral surface of the inner bit 3. Therefore, efficiency in recovering the drill waste through the distal end groove 18 is improved.

In the above-described embodiment, half or more of a plurality of the distal end blow holes 15 has been described as being the distal end blow holes 15A. However, if at least one the distal end blow hole 15A is provided, the above-described effects are exhibited. However, as in the above-described embodiment, in a case where the distal end blow holes 15A are provided half or more of the total, since the effects become more remarkable, it is preferable. In addition, it is more preferable that all the distal end blow holes 15 are made as the distal end blow holes 15A.

Further, the outer peripheral groove 19 extends toward the discharge groove 14 from the outer peripheral blow hole 16 to be gradually inclined toward the base end side and toward the tool rotation direction T (to the front in the tool rotation direction T). However, there is not limitation thereto. That is, the outer peripheral groove 19 may extend toward the discharge groove 14 from the outer peripheral blow hole 16 so as to be gradually inclined toward the base end side and toward the rear in the tool rotation direction T. That is, in FIG. 3, the outer peripheral groove 19 is located at the rear in the tool rotation direction T relative to the discharge groove 14. However, instead of this, the outer peripheral groove 19 may be disposed at the front in the tool rotation direction T relative to the discharge groove 14 and communicate with the discharge groove 14. Alternatively, the outer peripheral grooves 19 communicating with the discharge groove 14 may be respectively formed on both sides (the front and the rear in the tool rotation direction T) with the discharge groove 14 interposed therebetween.

In addition, the respective configurations (constituent elements) described in the above-described embodiment, the modified examples, the proviso, and the like may be combined within a scope which does not depart from the gist of the present invention, and additions, omissions, substitution, and other changes in the configuration are possible. Further, the present invention is not limited by the above-described embodiment and is limited by only the appended claims.

INDUSTRIAL APPLICABILITY

According to the present invention, the fluid ejected from the supply hole of the inner bit and the drill waste generated by excavation can be efficiently recovered into the discharge groove of the inner bit and can be stably discharged toward the base end side of the tool through the discharge groove. Thereby, it is possible to highly efficiently and stably proceed with drilling tasks and to limit the influence on the ground around the borehole.

Therefore, the present invention has industrial applicability.

REFERENCE SIGNS LIST

1: drilling tool
2: casing pipe
3: inner bit
4: ring bit
8: tip on distal end surface of inner bit
8A: tip on gauge surface
8B, 8C: tip on face surface
9: gauge surface
10: face surface
13: supply hole
14: discharge groove
15: distal end blow hole
15A: distal end blow hole
16: outer peripheral blow hole
18: distal end groove
19: outer peripheral groove
H1: amount of protrusion of tip from gauge surface
H2: amount of protrusion of tip from face surface
O: axial line
T: tool rotation direction

The invention claimed is:

1. A drilling tool used for excavating a ground to form a borehole, the tool comprising:

a casing pipe having a cylindrical shape;

an inner bit which is inserted into the casing pipe in a direction of an axial line thereof and of which a distal end portion in the direction of the axial line protrudes from a distal end of the casing pipe; and a ring bit which has an annular shape, is disposed at a distal end portion of the casing pipe so as to be rotatable around the axial line relative to the casing pipe, surrounds the distal end portion of the inner bit, and is capable of engaging with the inner bit around the axial line and from a distal end side of the inner bit in the direction of the axial line, wherein the inner bit is provided with:

a supply hole which passes through the inner bit and is open at the distal end portion of the inner bit; and a discharge groove which is formed in an outer peripheral surface of the inner bit and extends in the direction of the axial line, the supply hole is provided with:

a distal end blow hole which is open in a distal end surface of the distal end portion of the inner bit; and an outer peripheral blow hole which is open in an outer peripheral surface of the distal end portion of the inner bit, an outer peripheral groove through which the outer peripheral blow hole and the discharge groove communicate with each other is formed in the outer peripheral surface of the inner bit, and the outer peripheral groove is covered with the ring bit from the outside in a radial direction and extends toward the discharge groove from the outer peripheral blow hole so as to become gradually closer to the base end side in the direction of the axial line around the axial line.

2. The drilling tool according to claim 1, wherein the distal end blow hole is formed in the distal end surface of the inner bit and is open into a distal end groove which communicates with the discharge groove; and the outer peripheral blow hole is open into the outer peripheral groove.

3. The drilling tool according to claim 1, wherein a plurality of the distal end blow holes are open in the distal end surface of the inner bit, and at least one of the distal end blow holes extends so as to be parallel to the axial line or extends so as to gradually approach the axial line toward the distal end side of the tool.

4. The drilling tool according to claim 1, wherein in the direction of the axial line, the distal end surface of the ring bit is disposed at the same position as the distal end surface of the inner bit or disposed so as to protrude toward the distal end side of the tool relative to the distal end surface of the inner bit.

5. The drilling tool according to claim 1, wherein a plurality of tips protruding from the distal end surface of the inner bit are disposed on the distal end surface of the inner bit;

an outer peripheral edge portion in the distal end surface of the inner bit is made as a gauge surface which gradually extends toward the base end side in the direction of the axial line and toward the outside in the radial direction in a longitudinal cross-sectional view of the drilling tool;

the inside in the radial direction of the gauge surface in the distal end surface of the inner bit is made as a face surface; and the amount of protrusion from the face surface of each of the tips disposed on the face surface among a plurality of the tips is larger than the amount of protrusion from the gauge surface of each of the tips disposed on the gauge surface among a plurality of the tips.

6. The drilling tool according to claim 2, wherein the distal end groove gradually extends toward the side opposite to a tool rotation direction and toward the outside in the radial direction from the distal end blow hole.

7. The drilling tool according to claim 1, wherein the outer peripheral groove gradually extends toward the base end side in the direction of the axial line and toward a rotation direction of the inner bit.

8. The drilling tool according to claim 5, wherein the face surface comprises: a first receding surface receding to the base end side in the direction of the axial line; and a second receding surface receding toward the base end side in the direction of the axial line relative to the first receding surface, and the amount of protrusion from the first receding surface of each of the tips disposed on the first receding surface among a plurality of the tips is the same as the amount of protrusion from the second receding surface of each of the tips disposed on the second receding surface among a plurality of the tips.

9. The drilling tool according to claim 5, wherein the face surface comprises: a first receding surface receding to the base end side in the direction of the axial line; and a second receding surface receding toward the base end side in the direction of the axial line relative to the first receding surface, and in the direction of the axial line, a position of a distal end of each of the tips disposed on the first receding surface among a plurality of the tips is the same as a position of a distal end of each of the tips disposed on the second receding surface among a plurality of the tips.

10. The drilling tool according to claim 2, wherein a plurality of the distal end blow holes are open in the distal end surface of the inner bit, and at least one of the distal end blow holes extends so as to be parallel to the axial line or extends so as to gradually approach the axial line toward the distal end side of the tool.

11. The drilling tool according to claim 2, wherein in the direction of the axial line, the distal end surface of the ring bit is disposed at the same position as the distal end surface of the inner bit or disposed so as to protrude toward the distal end side of the tool relative to the distal end surface of the inner bit.

12. The drilling tool according to claim 3, wherein in the direction of the axial line, the distal end surface of the ring bit is disposed at the same position as the distal end surface of the inner bit or disposed so as to protrude toward the distal end side of the tool relative to the distal end surface of the inner bit.

13. The drilling tool according to claim 2, wherein a plurality of tips protruding from the distal end surface of the inner bit are disposed on the distal end surface of the inner bit;

an outer peripheral edge portion in the distal end surface of the inner bit is made as a gauge surface which gradually extends toward the base end side in the direction of the axial line and toward the outside in the radial direction in a longitudinal cross-sectional view of the drilling tool;

the inside in the radial direction of the gauge surface in the distal end surface of the inner bit is made as a face surface; and the amount of protrusion from the face surface of each of the tips disposed on the face surface among a plurality of the tips is larger than the amount of protrusion from the gauge surface of each of the tips disposed on the gauge surface among a plurality of the tips.

14. The drilling tool according to claim 3, wherein a plurality of tips protruding from the distal end surface of the inner bit are disposed on the distal end surface of the inner bit;

an outer peripheral edge portion in the distal end surface of the inner bit is made as a gauge surface which gradually extends toward the base end side in the direction of the axial line and toward the outside in the radial direction in a longitudinal cross-sectional view of the drilling tool;

the inside in the radial direction of the gauge surface in the distal end surface of the inner bit is made as a face surface; and the amount of protrusion from the face surface of each of the tips disposed on the face surface among a plurality of the tips is larger than the amount of protrusion from the gauge surface of each of the tips disposed on the gauge surface among a plurality of the tips.

15. The drilling tool according to claim 3, wherein the distal end groove gradually extends toward the side opposite to a tool rotation direction and toward the outside in the radial direction from the distal end blow hole.

16. The drilling tool according to claim 4, wherein the distal end groove gradually extends toward the side opposite to a tool rotation direction and toward the outside in the radial direction from the distal end blow hole.

17. The drilling tool according to claim 6, wherein the face surface comprises: a first receding surface receding to the base end side in the direction of the axial line; and a second receding surface receding toward the base end side in the direction of the axial line relative to the first receding surface, and the amount of protrusion from the first receding surface of each of the tips disposed on the first receding surface among a plurality of the tips is the same as the amount of protrusion from the second receding surface of each of the tips disposed on the second receding surface among a plurality of the tips.

18. The drilling tool according to claim 7, wherein the face surface comprises: a first receding surface receding to the base end side in the direction of the axial line; and a second receding surface receding toward the base end side in the direction of the axial line relative to the first receding surface, and the amount of protrusion from the first receding surface of each of the tips disposed on the first receding surface among a plurality of the tips is the same as the amount of protrusion from the second receding surface of each of the tips disposed on the second receding surface among a plurality of the tips.

19. The drilling tool according to claim 6, wherein the face surface comprises: a first receding surface receding to the base end side in the direction of the axial line; and a second receding surface receding toward the base end side in the direction of the axial line relative to the first receding surface, and in the direction of the axial line, a position of a distal end of each of the tips disposed on the first receding surface among a plurality of the tips is the same as a position of a distal end of each of the tips disposed on the second receding surface among a plurality of the tips.

20. The drilling tool according to claim 7, wherein the face surface comprises: a first receding surface receding to the base end side in the direction of the axial line; and a second receding surface receding toward the base end side in the direction of the axial line relative to the first receding surface, and in the direction of the axial line, a position of a distal end of each of the tips disposed on the first receding surface among a plurality of the tips is the same as a position of a distal end of each of the tips disposed on the second receding surface among a plurality of the tips.

* * * * *